US008167056B2

(12) United States Patent
Ito et al.

(10) Patent No.: US 8,167,056 B2
(45) Date of Patent: May 1, 2012

(54) RECHARGEABLE ELECTRIC TOOL

(75) Inventors: Yoshihiro Ito, Anjo (JP); Koji Takahagi, Anjo (JP)

(73) Assignee: Makita Corporation, Anjo (JP)

( * ) Notice: Subject to any disclaimer, the term of this patent is extended or adjusted under 35 U.S.C. 154(b) by 216 days.

(21) Appl. No.: 12/461,325

(22) Filed: Aug. 7, 2009

(65) Prior Publication Data

US 2010/0031781 A1 Feb. 11, 2010

(30) Foreign Application Priority Data

Aug. 11, 2008 (JP) ..... 2008-207278

(51) Int. Cl.
*B25F 5/02* (2006.01)

(52) U.S. Cl. ..... 173/171; 224/268; 224/271; 81/180.1

(58) Field of Classification Search ..... 173/217; 227/156; 81/180.1; 224/163, 268–269, 271
See application file for complete search history.

(56) References Cited

U.S. PATENT DOCUMENTS

| | | | | |
|---|---|---|---|---|
| 6,679,406 | B2 * | 1/2004 | Sakai et al. | 224/269 |
| 6,688,407 | B2 * | 2/2004 | Etter et al. | 173/170 |
| 6,905,052 | B2 * | 6/2005 | Sakai et al. | 224/269 |
| 7,108,079 | B2 * | 9/2006 | Sakai et al. | 173/217 |
| 7,143,841 | B2 * | 12/2006 | Etter et al. | 173/170 |
| 7,222,767 | B1 * | 5/2007 | Yang | 227/130 |
| 7,344,054 | B2 * | 3/2008 | Sakai et al. | 224/269 |
| D567,615 | S * | 4/2008 | Taniguchi et al. | D8/68 |
| 7,490,746 | B2 * | 2/2009 | Sakai et al. | 224/269 |
| 2002/0122707 | A1 * | 9/2002 | Sakai et al. | 408/241 R |
| 2003/0132264 | A1 * | 7/2003 | Smolinski | 227/130 |
| 2003/0159843 | A1 * | 8/2003 | Sakai et al. | 173/216 |
| 2004/0074938 | A1 * | 4/2004 | Sakai et al. | 224/268 |
| 2005/0092792 | A1 * | 5/2005 | Sakai et al. | 224/269 |
| 2006/0088377 | A1 * | 4/2006 | Rejman et al. | 403/331 |
| 2006/0104735 | A1 * | 5/2006 | Zeiler et al. | 408/241 R |

FOREIGN PATENT DOCUMENTS

| | | |
|---|---|---|
| JP | U-06-085774 | 12/1994 |
| JP | A-2006-239851 | 9/2006 |
| JP | 2008062345 A * | 3/2008 |

* cited by examiner

*Primary Examiner* — Lindsay Low
*Assistant Examiner* — Andrew M Tecco
(74) *Attorney, Agent, or Firm* — Oliff & Berridge, PLC

(57) ABSTRACT

A rechargeable electric tool includes a housing having a lower end, to which a battery is attached, and a fastener tool configured to be attached to a lower side surface of the housing. The fastener tool includes a plate-like base portion, and an engagement portion joined to the base portion. The engagement portion protrudes rearward of the housing when the fastener tool is attached to the housing.

10 Claims, 5 Drawing Sheets

RECHARGEABLE ELECTRIC TOOL

This application claims the entire benefit of Japanese Patent Application No. 2008-207278 filed on Aug. 11, 2008 the entirety of which is incorporated by reference.

BACKGROUND OF THE INVENTION

1. Field of the Invention

The present invention relates to a portable and rechargeable electric tool such as an impact driver.

2. Description of Related Art

A rechargeable electric tool is provided with a fastener tool, which is engageable with and suspended from a waist belt or the like of an operator so that the operator can carry the electric tool without holding the electric tool by hand. For example, Japanese Laid-open Patent Publication No. 2006-239851 discloses a hanging ring (fastener tool), which is detachably mounted on a side surface of a main body of the electric tool while its engagement portion protrudes rearward of the main body. Japanese Laid-open Utility Model Publication No. 06-85774 also discloses a hanging ring (fastener tool) having end projections to be inserted into corresponding openings of a main body of the electric tool for allowing a rotation of the hanging ring with respect to the main body.

A rechargeable electric tool is generally configured such that a heavy battery pack is attached to a lower end of a handle extending downward from the main body of the electric tool. For this reason, the electric tool as disclosed in JP 2006-239851 A, in which the fastener tool is provided rearward of the main body, is apt to swing forward and backward and thus unstable when it is suspended from a waist belt or the like and carried by an operator without using his hand. If the fastener tool is provided at the lower end of the handle as disclosed in JU 06-85774 A, this forward-and-backward swinging motion of the electric tool can be suppressed. However, a pivoting mechanism of the fastener tool may allow the electric tool to swing right and left directions, which leads to a loss of stability of the electric tool in the end. Further, since the fastener tool is provided on the rear surface side of the handle, a distal end (bit-side) of the main body protrudes in a sideward direction and disrupts the operator's work.

In view of the above drawbacks of the conventional art, the present invention seeks to provide a rechargeable electric tool, which can maintain a good posture while it is suspended from the waist belt or the like, which improves stability when it is carried by the operator without using his hand.

The present invention has been made in an attempt to eliminate the above disadvantages, and illustrative, non-limiting embodiments of the present invention overcome the above disadvantages and other disadvantages not described above.

SUMMARY OF THE INVENTION

In order to achieve the above object, according to the present invention, a rechargeable electric tool comprises: a housing having a lower end, to which a battery is attached; and a fastener tool configured to be attached to a lower side surface of the housing, wherein the fastener tool comprises an engagement portion which protrudes rearward of the housing when the fastener tool is attached to the housing.

In order to simply and reliably attach the fastener tool to the housing as well as to further improve the stability of the rechargeable electric tool when it is carried by the operator without using his hand, according to a first specific embodiment of the present invention, the fastener tool may be attached to the housing in such a manner that a base portion of the fastener tool is screwed to the side surface of the housing at a screwing position through a screw hole provided in the housing while an anti-rotation member protruding from the base portion is inserted into a corresponding recessed portion provided in the side surface of the housing at a position different from the screwing position.

In order to further improve usability of the electric tool, according to a second specific embodiment of the present invention based on the first specific embodiment, the screw hole for screwing the fastener tool and the recessed portion may be provided in the housing on each side surface thereof in a symmetrical manner, so as to allow the fastener tool to be attached to any one of these side surfaces.

In order to further improve usability of the electric tool, according to a third specific embodiment of the present invention based on the first or the second specific embodiment, the fastener tool may be configured to be attached to the housing in a plurality of different postures which cause the engagement portion to protrude from the housing at different protrusion angles.

With the above configuration of the present invention, since the engagement portion protrudes rearward of the housing, the rechargeable electric tool can be suspended from a waist belt or the like while maintaining a good posture and improve stability when it is carried by the operator without using his hand.

With the above configuration of the first specific embodiment of the present invention, in addition to the above advantageous effects of the present invention, since the anti-rotation member and the recessed portion are employed, it is possible to simply and reliably attach the fastener tool to the housing and to further improve the stability of the rechargeable electric tool when it is carried by the operator without using his hand.

With the above configuration of the second specific embodiment of the present invention, in addition to the above advantageous effects of the first specific embodiment, since the fastener tool can be attached to any one of the right and left side surfaces of the housing, it is possible to select one of these side positions which is easy to handle the electric tool and to carry the electric tool in this position, so that the usability of the electric tool can be improved further.

With the above configuration of the third specific embodiment of the present invention, in addition to the above advantageous effects of the first or second specific embodiment, it is possible to select the protrusion angle of the engagement portion, since the fastener tool is configured to be attached to the housing in a plurality of different postures. This can improve the usability of the electric tool further.

BRIEF DESCRIPTION OF THE DRAWINGS

The above aspect, other advantages and further features of the present invention will become more apparent by describing in detail illustrative, non-limiting embodiments thereof with reference to the accompanying drawings, in which:

FIGS. 2A to 2C are explanatory views of the fastener tool, in which FIG. 2A is a top view, FIG. 2B is a side view, and FIG. 2C is a bottom view;

FIGS. 3A and 3B are perspective views of the fastener tool, in which FIG. 3A is seen from the top side, and FIG. 3B is seen from the back side;

DETAILED DESCRIPTION OF THE EXEMPLARY EMBODIMENTS

With reference to the accompanying drawings, the present invention will be described in detail.

Figure 1:
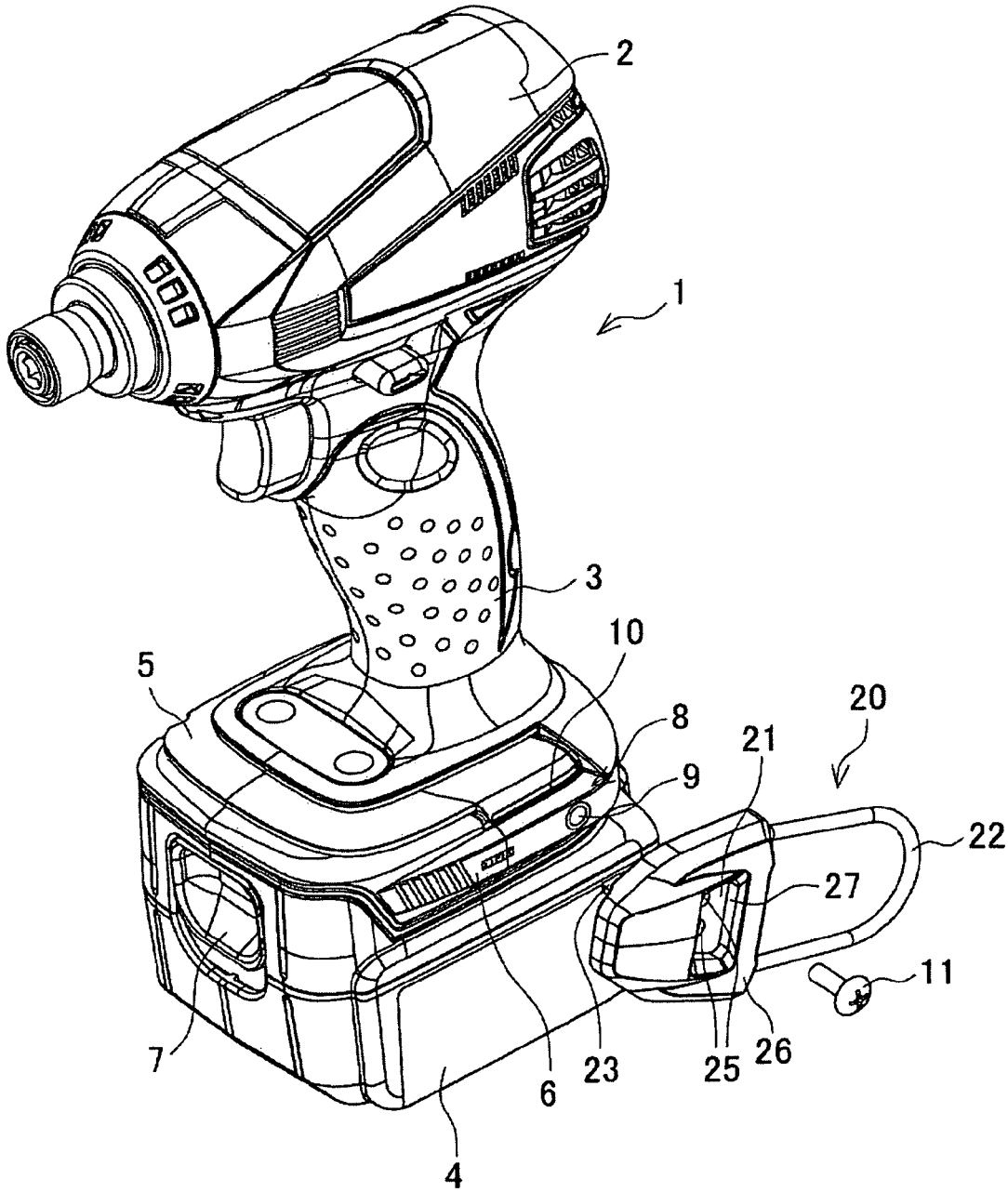
FIG. 1 is an exploded perspective view of an impact driver and a fastener tool according to one exemplary embodiment of the present invention.
Figure 2A:
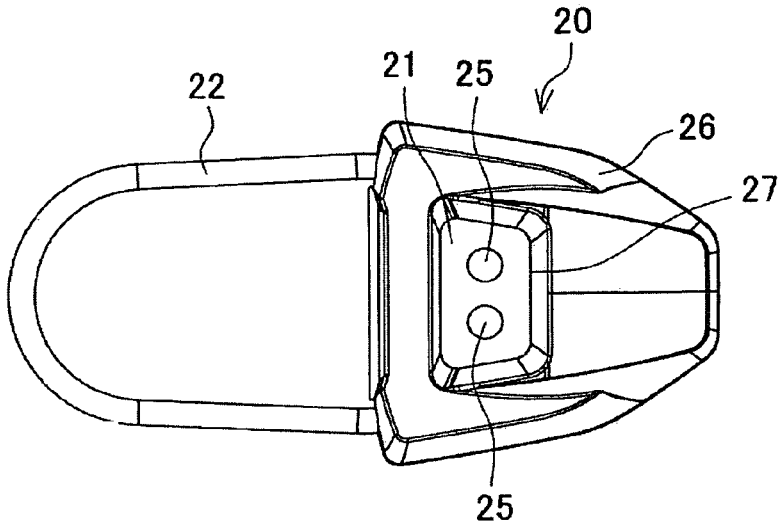
Figure 2B:
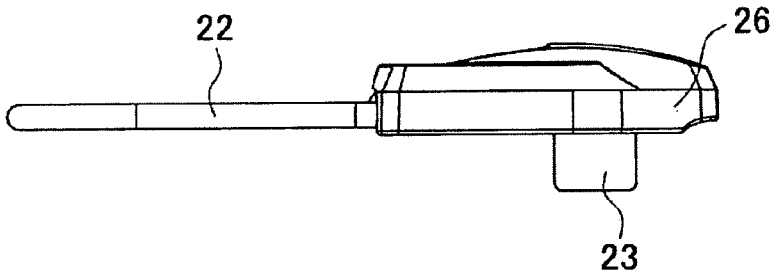
Figure 2C:
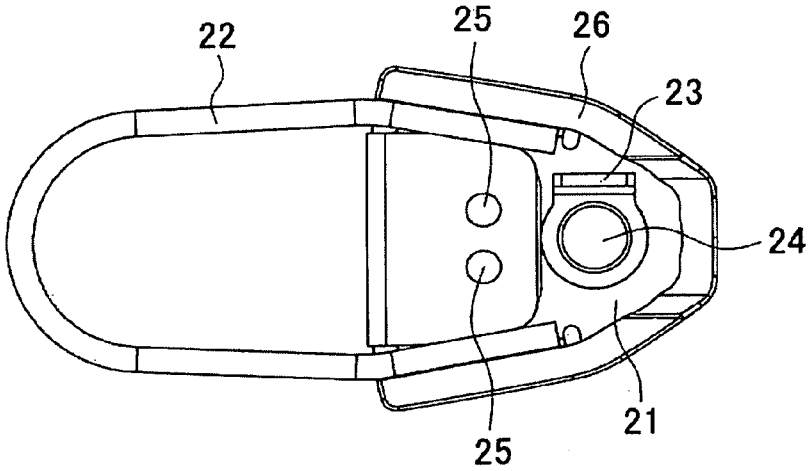
Figure 3A:
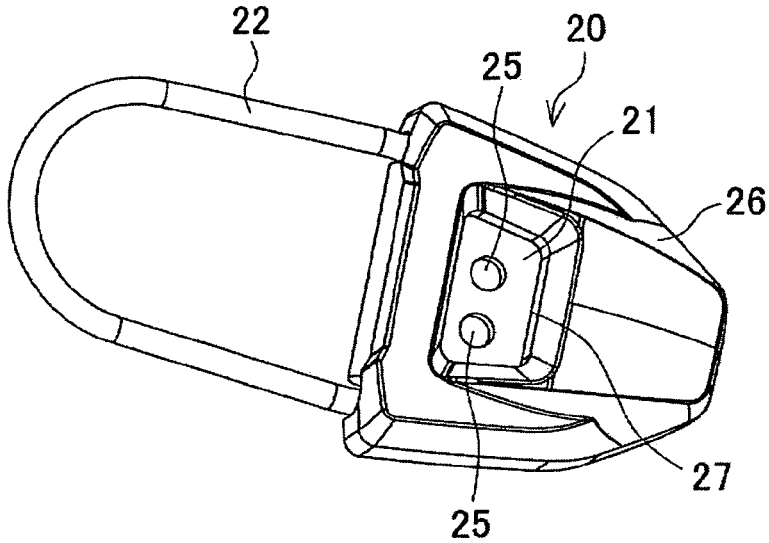
Figure 3B:
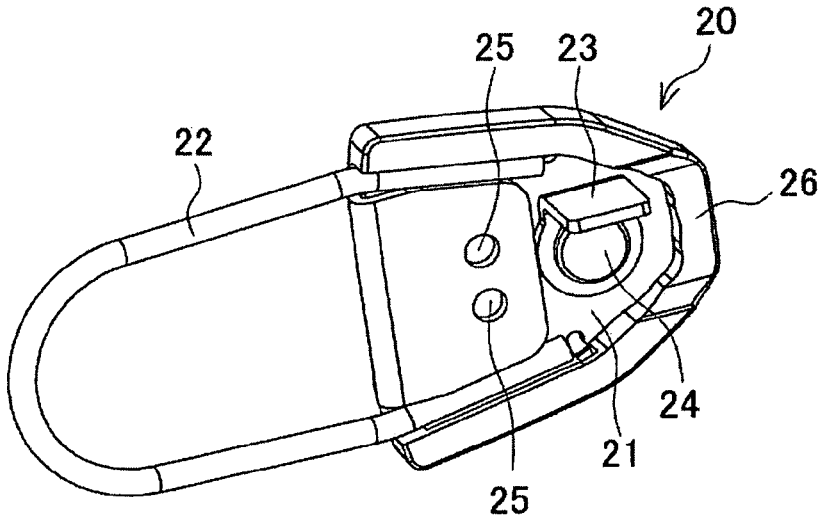
Figure 4:
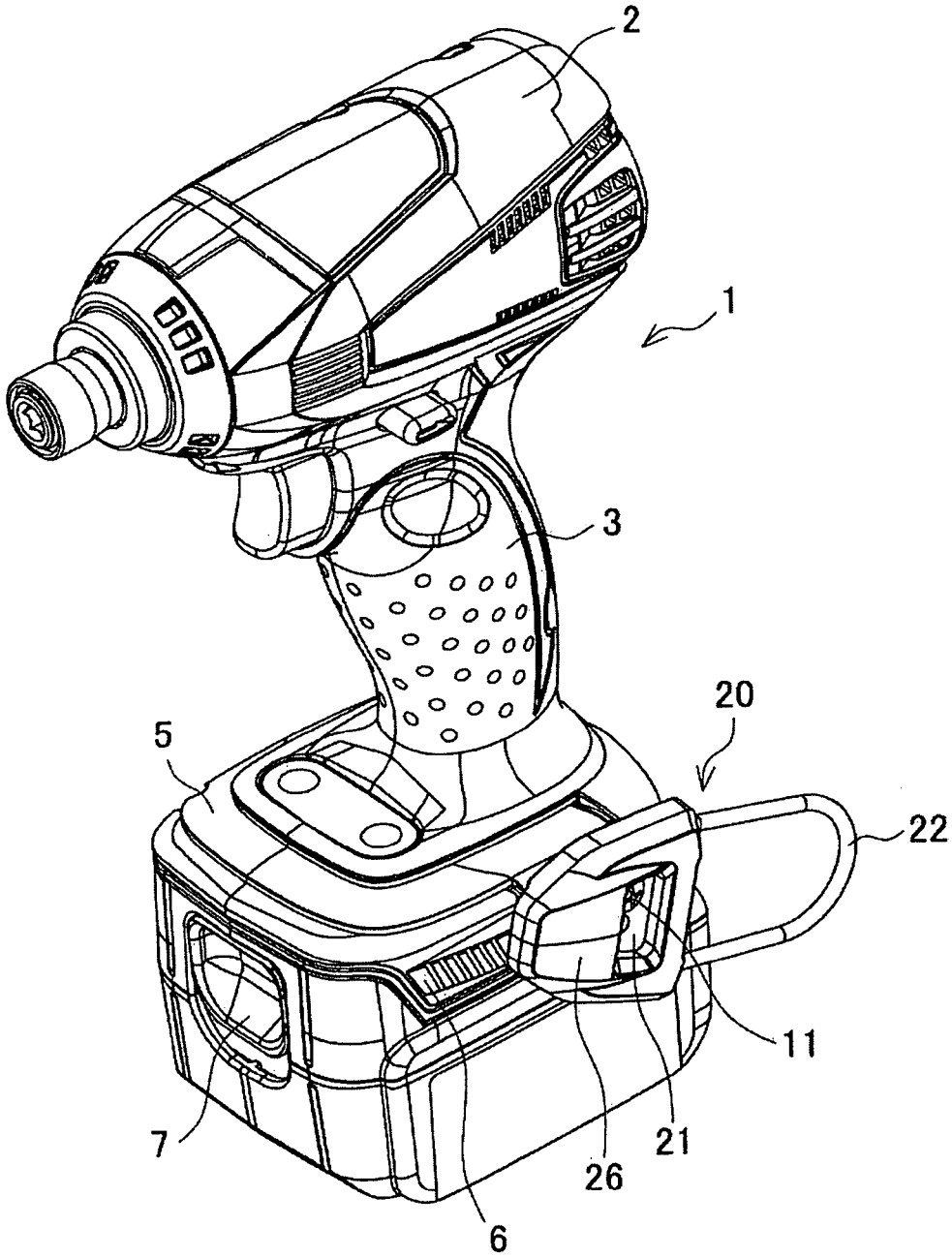
FIG. 4 is a perspective view of the impact driver to which the fastener tool has been attached.

An impact driver as one exemplary embodiment of a rechargeable electric tool is shown in a perspective view of FIG. 1. As seen in FIG. 1, the impact driver includes: a main body 2 which accommodates a motor and a rotary impact mechanism; a handle 3 as a housing which is positioned below the main body 2 and extends downward from the main body 2; and a battery pack 4 as a battery which is attached to a lower end of the handle 3. An attachment portion 5 having an enlarged bottom is provided at the lower end of the handle 3, and a pair of guide rails 6, 6 are provided at right and left sides of the attachment portion 5. Meanwhile, a pair of slide rails (not shown) are provided on a top surface of the battery pack 4. When the battery pack 4 is attached to the handle 3, the pair of slide rails on the top surface of the battery pack 4 are inserted into and slide along the corresponding guide rails 6, 6 of the attachment portion 5 from the front side. By this sliding engagement of the battery pack 4, the battery pack 4 is retained in the guide rails 6, 6 of the attachment portion 5 at an attached position. At this position, a terminal provided on the attachment portion 5 and a terminal provided on the top surface of the battery pack 4 are electrically connected. Reference numeral 7 indicates a lock button which is locked to the front end of the attachment portion 5 when the battery pack 4 is positioned in the attached position.

A mount portion 8 for the fastener tool 20 is provided near the lower end of the handle 3 at an outer surface of each right and left guide rail 6. The mount portion 8 comprises a screw hole 9, and a slit 10 as a recessed portion which is provided above the screw hole 9 and extends forward along the front-and-back direction of the guide rail 6. The mount portion 8 is provided on each right and left guide rail 6 in a symmetrical manner.

As seen in FIGS. 2A-2C and FIGS. 3A and 3B, the fastener tool 20 includes a plate-like base portion 21, and an engagement portion 22 joined to the base portion 21. An L-shaped anti-rotation strip 23 (anti-rotation member) is provided at a center region of a width of the base portion 21. The anti-rotation strip 23 has a distal end which protrudes orthogonally from the base portion 21, and is rotatably supported on the base portion 21 by a rivet 24. Further, a pair of mount holes 25, 25 are provided in a region of the base portion 21 surrounded by the anti-rotation strip 23 and the engagement portion 22 so that the fastener tool 20 is screwed to the handle 3 by inserting and screwing a screw 11 through one of the mount holes 25, 25 and the screw hole 9 while the anti-rotation strip 23 is being inserted into the slit 10. The mount holes 25, 25 are arranged symmetrically with respect to a center line of the base portion 21 across an axial center of the rivet 24. Reference numeral 26 indicates a resin cover which covers a front and a periphery of the base portion 21. A window 27 is provided in the front surface of the resin cover to expose the mount holes 25, 25.

The engagement portion 22 is a U-shaped metal member which is formed by bending a metal rod. Both ends of the U-shaped metal member are joined to the base portion 21 so that a looped portion protrudes from the base portion 21.

Figure 5:
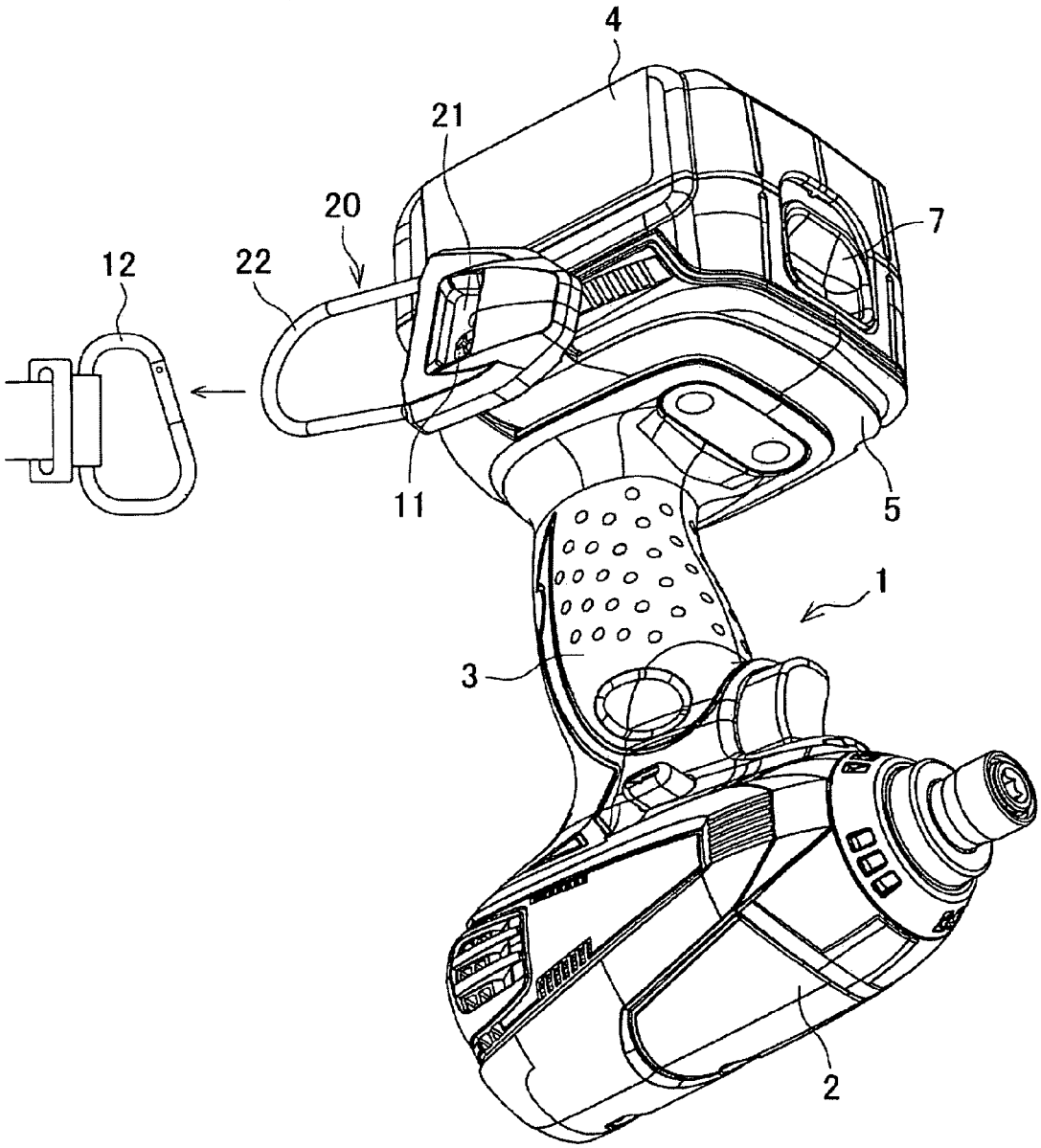
FIG. 5 is an explanatory view showing a state in which the impact driver is suspended from a waist belt.

According to the impact driver 1 as described above, the fastener tool 20 is attached either to the right-side or the left-side mount portion 8 with the engagement portion 22 facing backward. To be more specific, the anti-rotation strip 23 of the fastener tool 20 is inserted into the slit 10, and the screw 11 is screwed into the screw hole 9 of the handle 3 either through the upper mount hole 25 or the lower mount hole 25 to be selected by the operator, so that as best seen in FIG. 5, the fastener tool 20 can be attached to the impact driver 1 in such a manner that the engagement portion 22 protrudes backward from the attachment portion 5 and the battery pack 4. Therefore, when the operator carries the impact driver 1, as seen in FIG. 5, the impact driver 1 is held upside down and suspended, for example, from a carabiner 12 secured to a waist belt of the operator using the engagement portion 22 of the fastener tool 20. If the operator wishes to carry the impact driver 1 in a right-left reversal manner, he can then attach the fastener tool 20 to the mount portion 8 which is on the opposite side. Since the anti-rotation strip 23 is rotatable, it is possible for the operator to insert the anti-rotation strip 23 into the opposite slit 10 with no difficulty.

As described above, according to the impact driver 1 in this preferred embodiment, the handle 3 has the lower end to which the battery pack 4 is attached, and the fastener tool 20 including the engagement portion 22 provided at one end portion thereof is attached to the lower side surface of the handle 3 with the engagement portion 22 protruding rearward of the handle 3. Therefore, the impact driver 1 can be suspended from the waist belt or the like of the operator with being in a good posture, and the stability of the impact driver 1 can be improved when it is carried by the operator without using his hand.

In particular, the fastener tool 20 is attached to the handle 3 in such a manner that the base portion 21 of the fastener tool 20 is screwed to the side surface of the handle 3 at a screwing position while the anti-rotation strip 23 protruding from the base portion 21 is inserted into the slit 10 in the side surface of the handle 3 at a position different from the screwing position. Therefore, the fastener tool 20 can be simply and reliably attached to the handle 3, and the stability of the impact driver 1 can be further improved when it is carried by the operator without using his hand.

Further, the screw hole 9 for screwing the fastener tool 20 and the slit 10 are provided in the handle 3 on each side surface thereof in a symmetrical manner, so as to allow the fastener tool 20 to be attached to any one of the right and left side surfaces of the handle 3. Therefore, it is possible to select one of these side positions which is easy to handle the impact driver 1 and to carry the impact driver 1 in this position, so that the usability of the impact driver 1 can be further improved.

Further, the fastener tool 20 is configured to be attached to the handle 3 in a plurality of different postures which causes the engagement portion 22 to protrude from the handle 3 at different protrusion angles. Therefore, it is possible to select the protrusion angle of the engagement portion 22, so that the usability of the impact driver 1 can be further improved.

Although the present invention has been described in detail with reference to the above preferred embodiment, the present invention is not limited to the above specific embodiment and various changes and modifications may be made without departing from the scope of the appended claims.

For example, the number of the mount holes 25 may be increased in the fastener tool 20, so that the protrusion angle of the engagement portion 22 can be selected in a more fine-adjustable manner. In this example, a plurality of discrete and parallel mount holes may be provided, or as an alternative, adjacent mount holes may be connected to each other at their ends to provide a continuous oblong hole. Further, instead of increasing the number of the mount holes 25, the number of the anti-rotation strips or the slits may be increased so as to allow the fastener tool 20 to be attached to the handle 3 in a plurality of different postures.

Moreover, the design of the attachment between the fastener tool 20 and the handle 3 may be varied such that the anti-rotation member is shaped as a pin and the recessed portion is configured to have a round-shape corresponding to the anti-rotation member. Alternatively, instead of providing the anti-rotation member discretely from the base portion 21, the anti-rotation member may be made of the same material with and configured to directly protrude from the base portion 21 and to be fitted into the corresponding recessed portion of the housing. Furthermore, the anti-rotation member and the recessed portion may be omitted, and the fastener tool 20 may be attached to the handle 3 by two screws.

According to the above preferred embodiment, the engagement portion 22 is loop-shaped to be engageable with a carabiner 12. However, the engagement portion 22 may be varied such that a carabiner is provided in the engagement portion 22 and a ring engageable with the carabiner is provided in the waist belt of the operator. As a further alternative, the engagement portion 22 may be shaped as a hook.

In the rechargeable electric tool according to the present invention, the attachment of the battery pack 4 is not limited to a sliding mount installation. The battery pack 4 may be attached to the handle 3 by inserting the upper part of the battery pack from below the handle 3. Of course, the rechargeable electric tool is not limited to the impact driver 1, and the fastener tool is applicable to other types of electric tools such as an impact wrench and an electric screwdriver, so that they can be suspended from the waist belt and carried by the operator without using his hand.

What is claimed is:

1. A rechargeable electric tool comprising:

a housing having a lower end, to which a battery is attached; and a fastener tool configured to be attached to a lower side surface of the housing, wherein the fastener tool comprises an engagement portion which protrudes rearward of the housing when the fastener tool is attached to the housing, wherein the fastener tool is attached to the housing in such a manner that a base portion of the fastener tool is screwed to the side surface of the housing at a screwing position through a screw hole provided in the housing and one of a plurality of mount holes provided in the fastener tool, while an anti-rotation member protruding from the base portion is inserted into a corresponding recessed portion provided in the side surface of the housing at a position different from the screwing position, the anti-rotation member is configured as an L-shaped anti-rotation strip that is supported on the base portion and rotatable relative to the fastener tool and has a distal end which protrudes orthogonally from the base portion, and the recessed portion is provided as a slit, wherein the anti-rotation strip and plurality of mount holes provided in the fastener tool are configured to allow the fastener tool to be rotatable relative to the housing and fixed at a plurality of positions.

2. A rechargeable electric tool according to claim 1, wherein the screw hole for screwing the fastener tool and the recessed portion are provided in the housing on each side surface thereof in a symmetrical manner, so as to allow the fastener tool to be attached to any one of the side surfaces.

3. A rechargeable electric tool according to claim 1, wherein the fastener tool is configured to be attached to the housing in a plurality of different postures which cause the engagement portion to protrude from the housing at different protrusion angles.

4. A rechargeable electric tool according to claim 2, wherein the fastener tool is configured to be attached to the housing in a plurality of different postures which cause the engagement portion to protrude from the housing at different protrusion angles.

5. A rechargeable electric tool according to claim 1, wherein the anti-rotation member is configured to be rotatable.

6. A rechargeable electric tool according to claim 3, wherein the plurality of mount holes are provided in the base portion of the fastener tool such that the fastener tool is screwed to the screw hole of the housing through one of the mount holes, and the protrusion angle of the engagement portion is varied in accordance with a mount hole to be selected.

7. A rechargeable electric tool according to claim 4, wherein the plurality of mount holes are provided in the base portion of the fastener tool such that the fastener tool is screwed to the screw hole of the housing through one of the mount holes, and the protrusion angle of the engagement portion is varied in accordance with a mount hole to be selected.

8. A rechargeable electric tool according to claim 1, wherein the engagement portion is configured as a U-shaped metal member, and both ends of the U-shaped metal member are joined to the base portion so that a looped portion protrudes from the base portion.

9. A rechargeable electric tool according to claim 1, wherein a pair of guide rails are provided at the lower end of the housing such that the battery is slidably attached to the housing through the guide rails, and an outer side of each guide rail is configured to allow the fastener tool to be attached thereto.

10. A rechargeable electric tool according to claim 1, wherein a resin cover is provided for covering a front surface and a periphery of the base portion.

* * * * *